US006139419A

United States Patent [19]

Abe

[11] Patent Number: 6,139,419

[45] Date of Patent: Oct. 31, 2000

[54] HIGH CAPACITY DISPENSER FOR EJECTING COINS AND TOKENS

[75] Inventor: Hiroshi Abe, Iwatsuki, Japan

[73] Assignee: Asahi Seiko Co., Ltd., Tokyo, Japan

[21] Appl. No.: 09/161,967

[22] Filed: Sep. 28, 1998

Related U.S. Application Data

[63] Continuation-in-part of application No. 08/854,907, May 13, 1997.

[30] Foreign Application Priority Data

Sep. 26, 1997 [JP] Japan ..... 9-301413

[51] Int. Cl.[7] ..... G07D 9/00; G07D 1/00

[52] U.S. Cl. ..... 453/17; 453/35; 453/57

[58] Field of Search ..... 453/57, 17, 35

[56] References Cited

U.S. PATENT DOCUMENTS

| | | | |
|---|---|---|---|
| 3,942,544 | 3/1976 | Breitenstein et al. | 453/17 |
| 4,466,453 | 8/1984 | Said et al. | 453/17 |
| 5,122,094 | 6/1992 | Abe . | |
| 5,190,495 | 3/1993 | Taxon | 453/57 |
| 5,326,312 | 7/1994 | Patroni . | |
| 5,484,334 | 1/1996 | Evdokimo | 453/57 |

FOREIGN PATENT DOCUMENTS

| | | | |
|---|---|---|---|
| 0501607 | 9/1992 | European Pat. Off. . | |
| 0 500 276 | 5/1937 | United Kingdom | 453/35 |
| 2221315 | 1/1990 | United Kingdom . | |

*Primary Examiner*—Robert P. Olszewski
*Assistant Examiner*—Bryan Jaketic
*Attorney, Agent, or Firm*—Price Gess & Ubell

[57] ABSTRACT

A coin storage and dispensing apparatus for storing and dispensing coins from a gaming machine includes a frame member for mounting in the gaming machine and for positioning a respective first container device and a second container device at a diagonal angle to support a surface. The first and second container devices store loose bulk coins with a coin transporting device rotably mounted in the second container device to pick up coins and to drop them in the first container device. A transitional groove structure is provided for aligning coins with the coin transporting device. A pivotable support plate is directly mounted to the first container device to support its weight and a sensor can monitor the presence of coins in the first container device and activate the coin transporting device when a predetermined presence of coins is sensed.

24 Claims, 5 Drawing Sheets

HIGH CAPACITY DISPENSER FOR EJECTING COINS AND TOKENS

RELATED APPLICATIONS

This application is a continuation-in-part application of U.S. patent Ser. No. 08/854,907 filed on May 13, 1997.

BACKGROUND OF THE INVENTION

1. Field of the Invention

The present invention concerns a high capacity dispenser apparatus capable of ejecting coins or tokens of a disk-like form from a substantial reservoir of bulk loose coins, and in particular, a large capacity ejection device for ejecting the coins one at a time, which is suitable for game machines in which a large quantity of tokens or coins are used to play the games and it is desired to efficiently dispense all of the tokens or coins.

2. Description of Related Art

Various types of coin ejection devices have been used with a coin feeding circular plate which rotates within a pot-like cylindrical container that can store tokens or coins in loose loading or bulk conditions. These coin ejection devices can be positioned in an upright, inclined position so that coins are picked up and fed out from within the container in a one-by-one arrangement. Such a coin ejection device wherein coins can be continuously discharged at a high speed is disclosed in Japanese Patent Application No. 2-152852 (1994) and U.S. Pat. No. 5,122,094. Referring to FIG. 5, a prospective view of a coin feeding device is disclosed, with a cross-sectional view illustrated in FIG. 6. A coin feeding disk 2 is in the shape of a cylindrical drum or thick plate, and has multiple coin receiving holes 5 positioned about the periphery of the plate. The plate can rotate clockwise about a center rotating axis 12. As shown, the plate 2 is rotating within a large pot-like cylindrical container 1 by an electric motor (not shown). Coins positioned in the container 1 are stirred by the interaction of projections 6 that are formed along a circumferential wall 4 that extends from the plate 2. The rotation of the plate 2 can stir the coins so that they can fit into the multiple coin receiving holes 5 that are opened in the circumferential direction as they rotate to the bottom of the disk 2.

Coins that enter the receiving holes 5 are able to pass through the receiving holes 5 and are slidably held on the surface of a large square support plate 11 as they are moved to a coin ejection opening 23 that is illustrated at the left side of FIG. 5. A coin feeding claw (not shown) assists in moving the coins and is held at the surface of the large square supporting plate 11 in a freely slideable manner adjacent to the back surface of plate 2. A guiding plate 15 is formed on the surface of the support plate 11 and a flange surrounding wall 22 is used for attaching the container 1. A coin which is pushed and moved with the feeding claw (not shown) can be guided by the flange surrounding wall 22 of the container 1 and the guiding plate 15. The coin is finally guided by a fixed guide roller (not shown) and a movable guide roller 26 to be ejected out from the coin outlet 23.

There are problems, however, in this arrangement in that the container 1 has a comparatively small capacity when ejecting coins at a high speed. Thus, although the ability to eject coins or disks at a high speed can be accomplished, the supply of coins are quickly exhausted. This can become particularly a problem in game machines wherein a large quantity of tokens are used to play games and, accordingly, the operation of the game machine would be interrupted if the tokens ran out during the game.

U.S. Pat. No. 5,190,495 discloses a high capacity coin hopper that relies upon the time intervals associated with a coin counter-mechanism to coordinate the driving of a pinwheel motor and a cylinder drive motor.

European Patent Application 501,607AI discloses a mechanism for dispensing coins from a spring supported coin bowl.

There is still a need in the art to improve the efficient use of the storage capacity of dispensers of coins and tokens that are to be ejected with reliable and economical components and to substantially reduce the replenishment requirements during the operation of a gaming machine.

OBJECTS AND SUMMARY OF THE INVENTION

The present invention provides a large capacity type ejection device for objects in disk form, such as coins, disks and tokens, and includes a first container device having a tubular or cylindrical shape positioned diagonally to a supporting surface and formed with an outlet ejection opening for objects in disk form at an opening along a bottom edge. An ejection device is also provided within the container device in a raised and inclined manner so that it can freely rotate. A conveying device is rotatably provided with a large annular configuration form arranged at an opening along an upper edge of the first container device so that it can rotate freely, and a second container device in the form of a large cylinder, with an improved transition configuration, is arranged in a manner so that it communicates with the conveying device for moving all of the disk-like objects.

The present invention further includes a disk body transporting apparatus characterized by having a central axis for the second container device being positioned below the central axis of a first container device and providing an annular groove to cooperate in aligning disk bodies when only a few remain in the second container. Standing pins, small recesses or projections can extend into the annular groove to assist in discharging the disk-like objects from the annular groove. The transporting apparatus is characterized by a conveying ring device for objects in a disk form having a holding device for the objects on the surface thereof. The conveying ring device is equipped with a gear arrangement at its outer surface, while the disk body ejecting apparatus is further characterized by providing a sensor means for detecting the weight of the container devices and coins to activate a second coin transporting member in the shape of a deep pan which forms a coin transport disk assembly. At the other side of the first container is another flange which supports a coin pick-up member that can move coins from a large hopper formed as the second container and drop them into the first container. An independent electric motor drives the coin pick-up member and it is activated when a switch senses a reduction in weight of the respective container assemblies. As a result, an increase in storage capacity is provided in a manner that can be accommodated within a gaming machine so that a high speed ejection of coins or tokens can be achieved.

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide a high capacity dispenser for coins and tokens.

Figure 1:
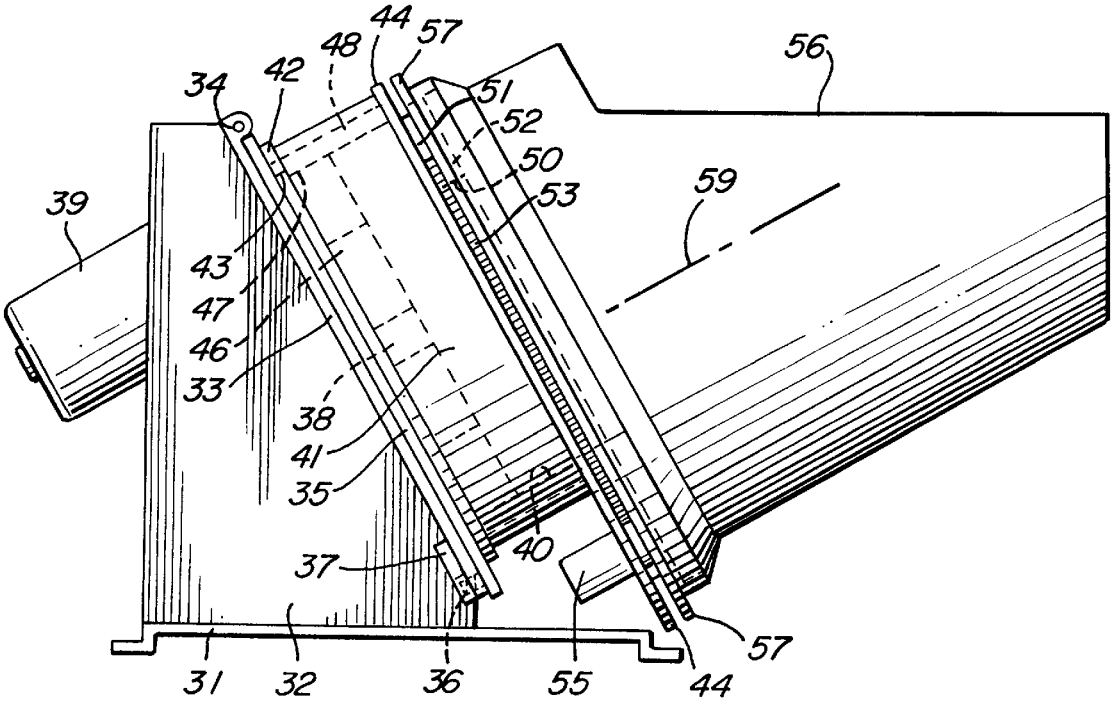
FIG. 1 is a schematic side view with phantom lines showing one embodiment of the invention.

Referring to FIG. 1, a schematic side view of a first embodiment of the present invention is disclosed. A base plate 31 can be of a rectangular configuration and is a dimension to be mounted or installed within conventional gaming machines. Base plate 31 is usually horizontally installed within a game machine that wishes to dispense medals, disks, tokens or coins, hereinafter referred to generically as "coins," such as those frequently utilized in casinos and arcades. Side triangular frame members 32 extend vertically upward on either side of the base plate 31. The pair of triangular frames 32 are respectively fixed to the base plate 31. A rectangular fixation plate 33 is mounted on the side of each of the frames 32 so that it is inclined relative to the base plate 31. As shown, there is an acute angle of 60 degrees between the base plate 31 and the fixation plate 33. The upper edge portion of the fixation plate 33 is configured to form hinges 34 on either side. These components comprise a stationary frame member. A movable plate 35 of a rectangular configuration is pivotally attached to the hinges 34 and can rotate away from the fixation plate 33. A hole can be provided in the lower surface of the fixation plate 33 so that it would be covered by the movable plate 35 and a spring 36 can be slidably inserted into the hole to provide a spring force against the movable plate 35. Note, additional springs can also be used if desired.

Figure 2:
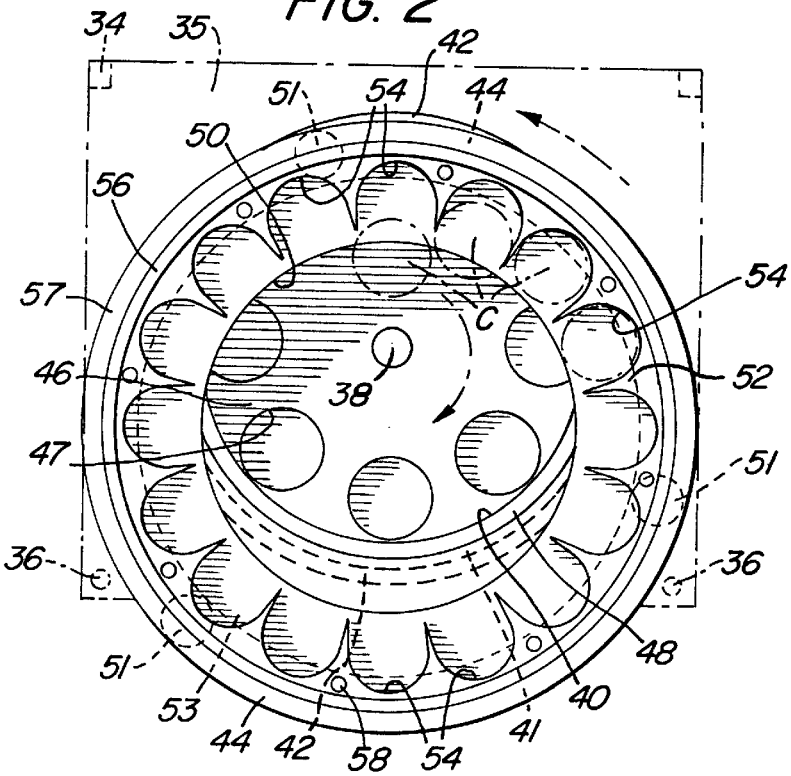
FIG. 2 is a schematic partial cross sectional view showing a front-end view from a diagonal perspective.

In the disclosed embodiment, a pair of coil-shaped springs 36 as mounted between the lower edge at respective end parts of the fixation plate 33 and the respective lower edge at both end parts of the movable plate 35 as schematically shown in FIG. 2. As a result of the spring force, if the movable plate 35, which will be described later, is supporting the weight of coins or tokens and the weight becomes less than a predetermined amount than the movable plate 35 will be slightly rotated upward about the hinges 34 as a result of the spring forces generated by the respective springs 36. A limit switch 37 or sensor is disclosed on the lower portion of the underside of the fixation plate 33 and it is mounted in such a manner so that it is turned on or off as a result of contact with the movable plate 35. Thus, the activation of the switch 37 will depend upon the desired weight and the predetermined spring forces designed for a particular application.

A storage tank or first container device 41 has a flange 42 which can be appropriately captured and held, for example, by bolt, nuts, welding, etc. (not shown) on the movable plate 35. In addition, an outlet aperture 43 of an appropriate size for receiving a disk body is formed along a portion of the flange 42 as shown in FIG. 1. The upper opening edge of the storage tank or first container 41 has a second flange 44. This flange 44 can be seen also in FIG. 2. The flange 44 extends parallel to the flange 42 and is cantilevered from the bottom of container member 41 to serve as a mounted support for an electric motor 55 that is capable of rotating and driving a ring member 52. A series of small gears 51 are arranged to rotate freely and are positioned at equal intervals around the circumferential direction to provide three support points as illustrated in FIG. 2. The ring member 52 is mounted within a second storage tank or second container device 56 and has on its upper surface a series of indentations 54 of a size and configuration to support a coin, disk or medal member. These indentations 54 are in the form of a "U" with the convex portion radially aligned with a central axis of the second container member 56. The indentations 54 are placed at equal intervals in a circumferential direction around the ring member 52 as illustrated in FIG. 2 and form a coin transporting device for picking up coins in the second container device and dropping them by gravity through an aperture into the first container device. The electric motor 55 can drive the ring member 52 through an interaction with gears 51 and 53. As can be seen in FIG. 1, the second container member 56 is in the form of a large cylinder with a flange 57 formed at an edge of the lower opening of the second member container 56. This flange is attached to the flange 44 and captures the gears 51 and 53 between the flanges. Although the illustration is omitted in the drawings, the flanges 44 and 57 can be attached together by appropriate bolts and nuts. The central axis 59 of the second container member 56 is positioned below a rotating shaft 38 which is positioned along the central axis of the first container member 41.

Rotatably mounted within the first container member 41 and adjacent the flange 42 is an apertured coin transporting disk 46 with a cylindrical wall. This disk 46 contains multiple through holes 47 formed in the circumferential direction of the disk 46 at equal intervals for stacking and storing disk-like objects. This disk coin transport member 46 is rotated by an electrical motor 39 through a speed reducer not shown to rotate a rotating shaft 38 which is operatively attached to disk 46. The rotating shaft 38 is positioned along the central axis of the disk transport member 46, as well as that of the first container member 41. The acute angle of this rotating shaft 38 and the baseplate 31 is approximately 30 degrees in the example shown. The purpose of the rotatable apertured disk 46 is to agitate and capture coins stored in the first container 41 and to transport them from the first container 41 for ejection from the aperture 43.

Figure 3:
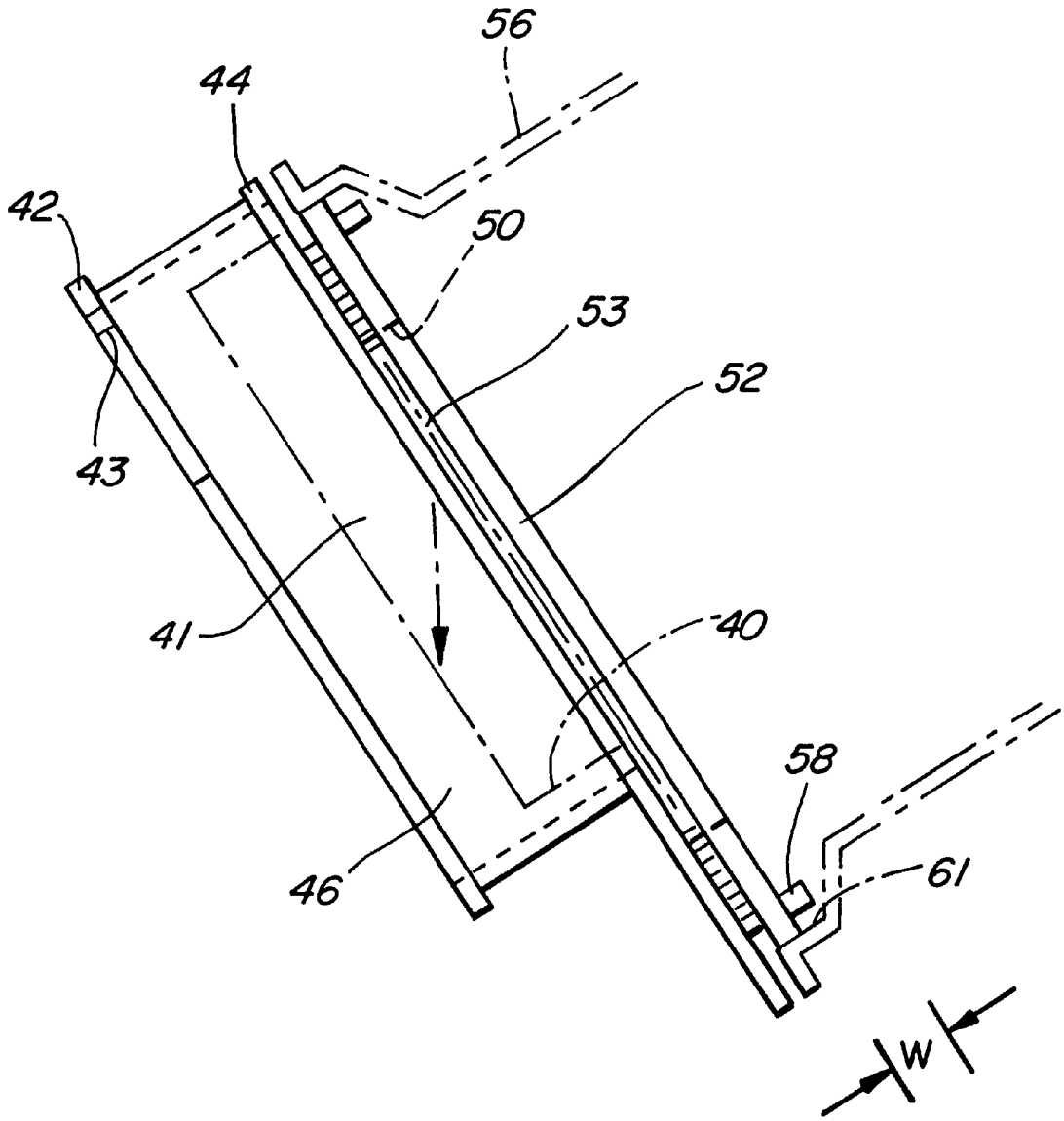
FIG. 3 is a partial side view of FIG. 1.

The lower portion or base of the second container number 56 is flared outward relative to the upper portion to provide a transition structure such as an annular groove 61. The annular groove 61 has an inclined flange that provides a transition from the cylindrical upper portion of the container number 56 to an enlarged cylindrical portion which forms with the inclined flange the groove 61. The groove 61 has a diameter to encompass the coin transporting ring 52 as shown in FIG. 3.

The groove 61 is used to assist in completely evacuating the second container number 56 from stored coins. Thus when the amount of coins in the second container member 56 becomes small, the groove 61 will assist in directing the few remaining coins to slide down the inclined flange and to align themselves in the groove 61 adjacent the coin transporting ring 52. Thus, the coins will slip out of the lower bottom of the second container member 56 and fall into the groove 61. The coins will be contacted by contact members on the ring 52 such as standing pins 58 and agitated to fall into the recesses 54 of the coin transporting ring 52.

It is desirable that the width W, of the groove 61, that is the distance between the surface of ring 52 and the inner bottom of the second container member 56 is larger than the radius of stored circular plate bodies or coins C.

The second container member 56 is open along its top to receive the disk-like coin members in bulk condition and the U-shaped indentations in the ring member 52 can capture a disk-like coin and transport it upward until it falls by gravity from the ring member 52 through a bottom aperture into the first container 41.

In operation, a large amount of the disk-like objects can be loaded in bulk within both the first container member 41, as well as the second container member 56. The coin transporting disk 46 is rotated clockwise, for example, as illustrated by the arrow at the lower part of FIG. 2, by the electric motor 39. In this manner, the coin-like objects (not shown) that have been loaded in bulk within the first container 41 are agitated to be stacked within the through holes 47 of the rotating transport disk member 46. The coin-like members at the bottom are positioned in the through holes 47 and move over the movable plate 35 so that eventually these coin-like disks can be ejected by force through the ejection opening 43 one by one by an ejecting arm as known in the industry. Projections or paddle members can be formed along the cylindrical wall of the rotating transport disk 46 in the container member 41 to assist in the agitation of the disk-like coins so that they can be positioned to fit within the through holes 47 at the bottom of the disk of the rotating transport disk 46.

As noted, the coin-like members that have entered the through holes 47 will then pass through the through holes 47 and will be held at the surface of the movable plate 35 in a freely sliding fashion. A feeding claw (not shown) is positioned or formed at the back surface of the transport disk member 46 and can be used to eject the coins.

As can be appreciated with reference to FIG. 1, the coins loaded respectively in the first container 41 and in the second container 56 can be initially discharged through only the rotation of the rotating transport disk 46. When a sufficient number of coins have been appropriately ejected, there will still be a reserve store of coins in the lower portion of the second container member 56. As can also be appreciated, however, the total weight of the coins will be reduced and accordingly the load on the removable plate 35 will correspondingly be reduced. As a result, the springs 36 can exert a force upward, thereby enabling the switch 37 to close and activate or drive the electric motor 55, which in turn will rotate a coin transporting ring 52. As the ring 52 rotates counterclockwise, for example, as illustrated by the arrow on the upper right-hand portion of FIG. 2, the disk-like objects that are at the lower part of the second container member 56 will be agitated and will fit into the indentations in the U-shaped forms or recesses 54 and will accordingly be transported and conveyed upward. The speed of rotation of the ring 52 does not generate sufficient centrifugal forces to hold the disk-like members in the indentations and they will fall by gravity downward as shown in FIG. 3 to be deposited within the first container 41, as indicated by the arrow in FIG. 3. Thus, the disk-like coin members are replenished from the second container 56 to the first container 41 and again the rotation of the transport disk 46 will cause these newly replenished coins to be positioned within the through holes 47 for subsequent ejection from the gaming machine.

The activation of the electric motor 55 by the switch 37 can be further subject to a timing circuit so that the electric motor 55 will again stop after a specific period of time unless activated again after a turning on or a continued on position of the switch 37.

It is also possible to stop the electric motor 55 after a predetermined number of coin-like disks are ejected.

As another modification, the coin transporting member 46 could be modified from a relatively deep pan-like cylindrical configuration to a thin disk with a plurality of cylindrically shaped pins vertically formed along its circumferential edge at equal intervals so that objects in a disk-like form can be held in such a manner that they are caught and conveyed by the pins. Additionally, the pins can take other configurations and cylindrical shapes such as flat or square small pins.

Additionally, the depth of the indentations or recesses 54 of the ring 52 can be altered so that they can be larger than the thickness of one disk-like object. The depth of this indentation can be determined in consideration of the size of the opening 50, the angle of the inclination of the ring 52, that is, the acute angle with the baseplate 51 is approximately 60 degrees in the present illustration, the size of the opening of the first container member 41 and the size of the opening 40 of the disk-like transport member 46, the falling direction of objects in the disk-form, etc.

While a plurality of indentations 54 were formed at the upper surface of the ring member 52, it can be appreciated that cylindrical flat or square pins, for example, can be utilized as described above in an alternative form of the invention.

Figure 4:
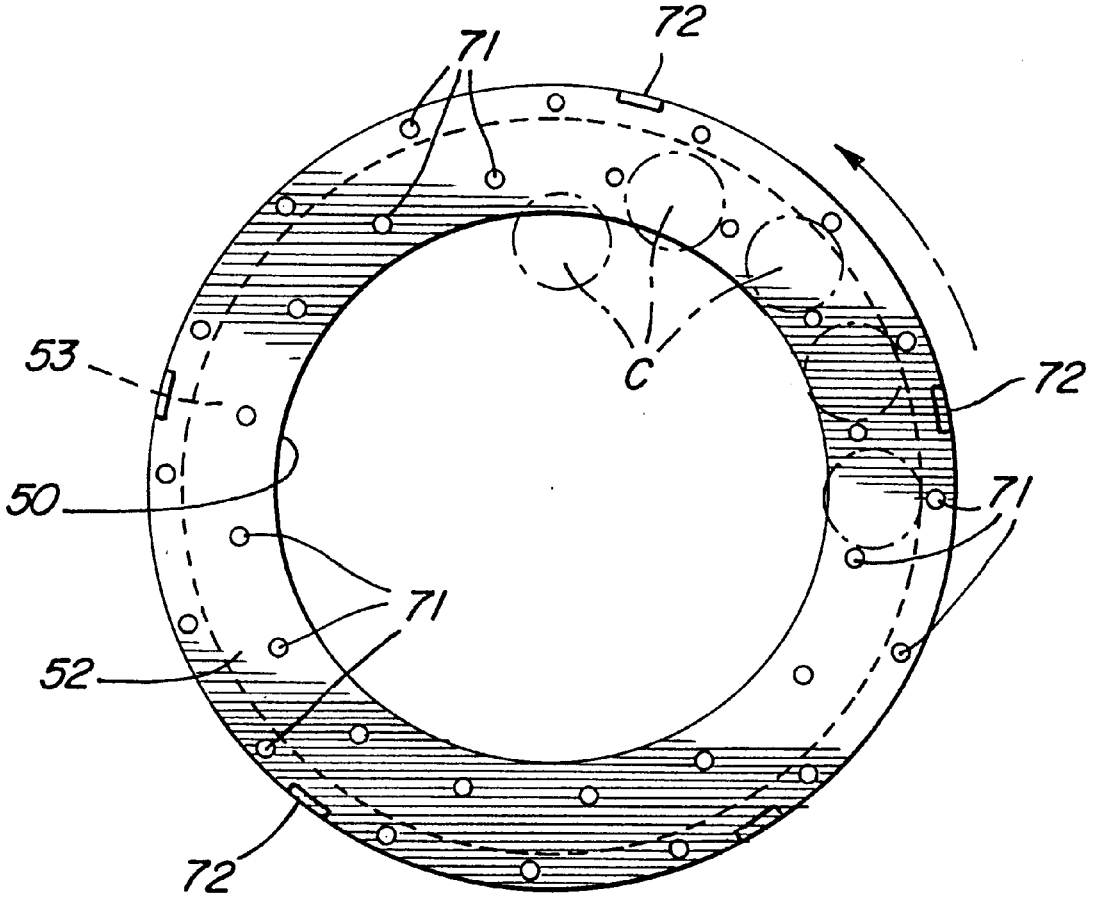
FIG. 4 is a partial front view of an alternative embodiment of a component of the present invention.
Figure 5:
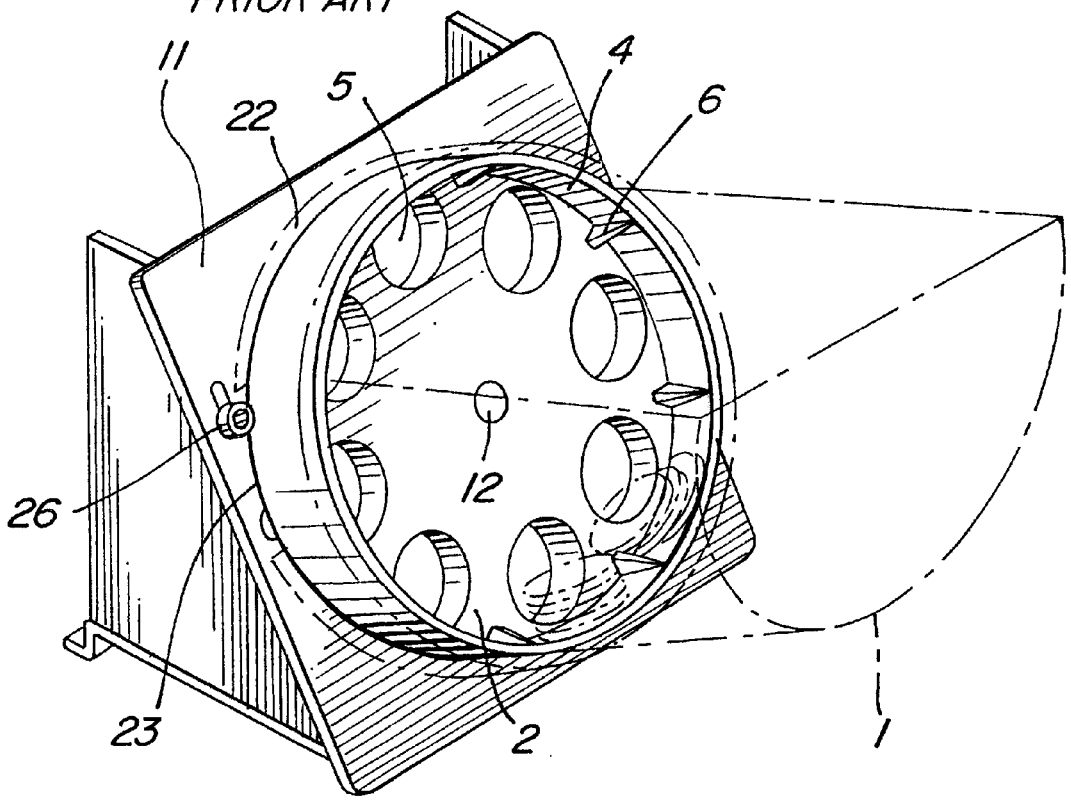
FIG. 5 PRIOR ART
FIG. 5 is a schematic partial perspective view of a conventional coin dispenser.
Figure 6:
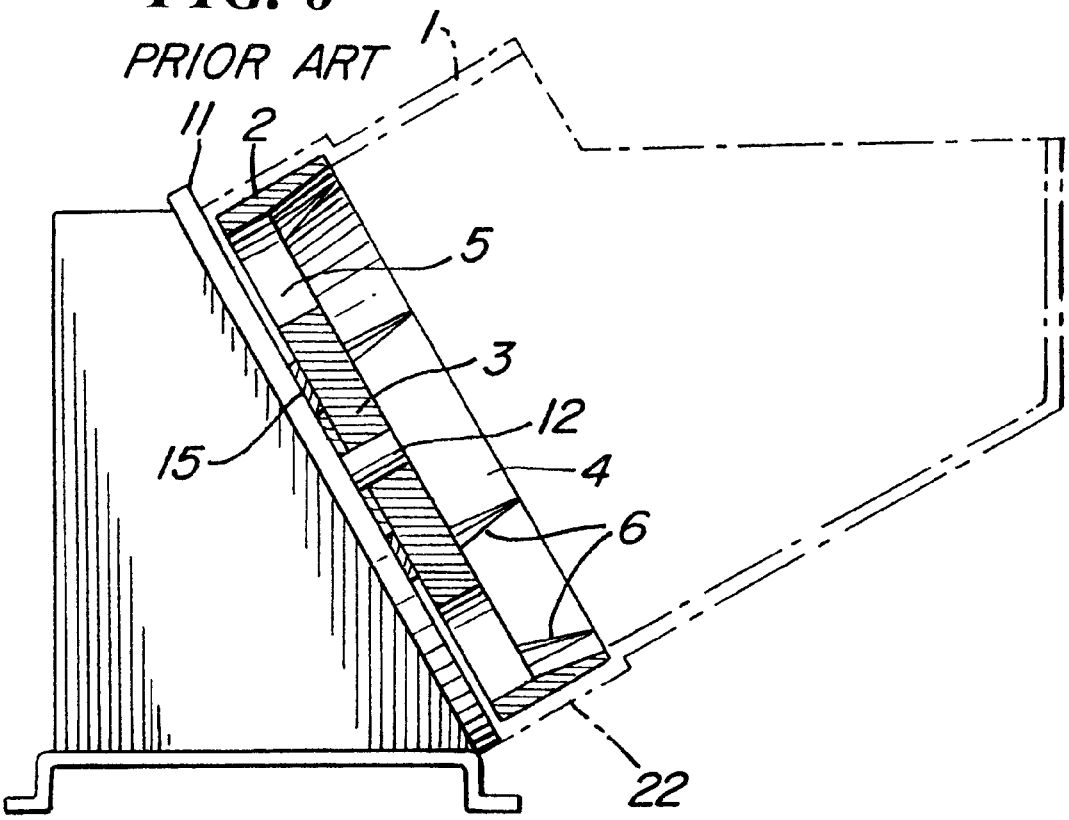
FIG. 6 PRIOR ART
FIG. 6 is a side schematic cross-sectional view of FIG. 5.

Reference can be made to FIG. 4 where the coin transporting ring member 52 can be formed with a series of pins 71 for agitating and capturing coins, C.

In FIG. 2, the pins 58 are positioned in suitable peripheral portions of the large ring 52. However, as shown in FIG. 4, step portions 72 which provide small recesses or projections may be used. Thus, the coins are flicked or propelled from the groove 61 as a result of the contact with the step portion 72. Accordingly, the coins can be contacted by either a plurality of pins 71 or the recesses 54.

Alternatively, instead of the combination of the spring 36 and the limit switch 37, a sensor such as a pressure sensitive element or a distortion or strain detection element (not shown) could be arranged at a section on the upper surface of the fixed plate 33 and the movable plate 35 could be eliminated such that a portion of the flange 42 of the first container member 41 would be brought into direct contact with the pressure sensitive element.

A transporting disk of a thin form which can be found, for example, in U.S. Pat. No. 4,589,433 and U.S. Pat. No. 5,181,881, could be used. Finally, instead of the gear apparatus of 51 and 54, a belt apparatus could be used or even a combination of a gear assembly and belt may be used.

In summary, the present invention adds a second storage container to a first storage container and positions a conveying means that can be uniquely activated to convey disk-like bodies from the second container to the first container. Accordingly, a large quantity of disk members can be stored and efficiently conveyed in an economical manner from the second storage container to the first storage container. By measuring the weight of the coins in the respective containers, the conveying means need only be operated at appropriate times. Additionally, the provision of the groove 61 assists in a complete transfer of stored coins.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A storage and dispensing apparatus for coins comprising:

a first storage member;

a first coin transport assembly operatively mounted to the first storage member for selectively removing coins from the first storage member;

a second storage member rotatable and mounted above the first storage member to rotate about a first axis and having a transition groove for causing a face of a coin to be aligned traverse to the axis;

a second coin transport assembly operatively mounted to the second storage member and positioned within the transition groove for selectively removing coins from the second storage member and transporting the coins by dropping the coins into the first storage member;

support means for movably mounting the first and second storage members so that their positions, relative to the support means, can depend on the weight of the coins in the respective storage members;

sensor means for monitoring the relative movement of the first and second storage members and providing a signal; and drive means for rotating the second coin transport assembly when the sensor means provides a signal whereby the coins stored in the second storage member can be transferred to the first storage member.

2. The storage and dispensing apparatus of claim 1 wherein the support means includes a frame member and a pivotably mounted support plate attached to the frame member.

3. The storage and dispensing apparatus of claim 2 wherein the support means includes a spring mounted between the frame member and the pivotably mounted support plate to bias the support plate away from the frame member at a predetermined force.

4. The storage and dispensing apparatus of claim 3 wherein the sensor means is mounted for operative contact with the pivotably mounted support plate.

5. The storage and dispensing apparatus of claim 1 wherein the transition structure includes a groove formed along an inside portion of a lower opening of the second storage member and the second coin transport assembly includes means for removing coins from the groove.

6. The storage and dispensing apparatus of claim 1 further including a flange on the first storage member wherein the second coin transport assembly is rotably mounted on the flange of the first storage member and a motor is mounted on the flange for driving the second coin transport assembly.

7. A large capacity ejection device for objects in a disk form, comprising:

a first cylindrical container device diagonally extending from a support surface and formed with an ejection opening for objects in disk form with an opening at a bottom edge;

an ejection device for objects in disk form arranged within the first container device so that it can rotate freely;

a conveying device arranged at an opening upper edge of the first cylindrical container device so that it can rotate freely to pick up the objects in disk form and drop them into the first cylindrical container; and a second cylindrical container device having an enlarged annular groove arranged so that it is positioned adjacent the conveying device for aligning objects in disk form from the second container device with the conveying device for transporting the objects to the first container device wherein the annular groove has a diameter larger than a diameter of the second cylindrical container and the conveying device includes means for preventing coins from jamming in the annular groove.

8. The ejection device of claim 7, wherein the annular groove includes an inclined flange and the conveying device includes a contact member that is positioned adjacent the inclined flange to agitate the objects in disk form supported by the inclined flange.

9. The ejection device of claim 7 wherein the conveying device is equipped with a holding device for supporting objects in disk form at its upper surface.

10. The ejection device of claim 9 wherein the holding device consists of a rotatable member with a series of indentations of a configuration complimentarily to the disks.

11. The ejection device of claim 9 wherein the holding device consists of a rotatable member with a series of pins positioned to engage and support the disks.

12. The ejection device of claim 7 wherein a sensor member detects the weight of the first and second containers and activates the conveying device at a predetermined weight to transfer coins.

13. The ejection device of claim 7 wherein the width of the groove is larger than a radius of the objects in disk form.

14. A coin storage and dispensing apparatus for storing and dispensing coins from a gaming machine, comprising:

a frame member for mounting in a gaming machine;

a first container device operatively mounted on the frame member for storing and ejecting coins;

a second container device operatively mounted to the first container device with an aperture centrally arranged between the first and second containers and having a flared flange for providing a groove whereby coins stored in the second container device can pass through the aperture to the first container device;

a coin transporting device rotatably mounted in the second container device about the aperture and adjacent the groove whereby coins that are stored in the second container device can be aligned by the groove so that they are releaseably secured to the coin transporting device to be dropped through the aperture into the first container device, the coin transporting device includes contact members positioned in the groove for contacting the coins and agitating the coins to facilitate the releasable securement; and a sensor member monitoring the presence of coins in the first container device and activating the coin transporting device to transfer coins from the second container device to the first container device when a predetermined presence of coins is sensed.

15. The coin storage and dispensing apparatus of claim 14 further including a support member pivotally connected to the frame member, the support member supports the weight of the first and second container devices.

16. The coin storage and dispensing apparatus of claim 15 wherein the sensor means is mounted between the frame member and the support member.

17. The coin storage and dispensing apparatus of claim 16 further including a spring member operatively positioned between the support member and the frame member and bracing the support member away from the frame member.

18. The coin storage and dispensing apparatus of claim 14 wherein the contact members include one of a projection and a recess on the surface of the coin transporting device.

19. The coin storage and dispensing apparatus of claim 15 wherein the coin transporting device includes a rotable apertured plate with indentations of a configuration to receive and support a coin.

20. The coin storage and dispensing apparatus of claim 15 wherein the coin transporting device includes a rotable apertured plate with a plurality of pins arranged to receive and support a coin.

21. A high capacity storage and dispensing apparatus for ejecting circular plate bodies, comprising:

a first storage member having openings at its upper and lower ends and operatively positioned to be inclined relative to a support surface, the lower end having an outlet for the circular plate bodies at the opening of the first storage member;

an ejecting device for ejecting a circular plate body which is rotatable and provided within the first storage member;

a second storage member positioned to substantially communicate with the upper opening of the first storage member, the second storage member having a groove formed along a lower opening of the second storage member adjacent the upper opening of the first storage member; and conveying means including a ring member, positioned within the groove, for conveying the circular plate bodies from the second storage member to the first storage member by rotating adjacent the upper opening of the first storage member.

22. The high capacity storage and dispensing apparatus of claim 21, wherein the groove can align circular plate bodies stored in the second storage member so that they are releasably secured to the conveying means, the ring member further includes one of recesses and projections that are aligned with the groove to agitate circular plate bodies in the groove, the ring member can releasably secure the circular plate bodies and gravity drops them into the first storage member.

23. The high capacity storage and dispensing apparatus of claim 21, wherein the groove includes an inclined flange and the ring member includes a contact member that is positioned adjacent the inclined flange to agitate the circular plate bodies supported by the inclined flange.

24. A storage and dispensing apparatus for storing and dispensing disk bodies comprising:

a first container device having a cylindrical configuration with an opening at an upper end and a lower end for receiving disk bodies, a central axis extends through the cylindrical configuration and is inclined relative to a support surface;

ejecting means connected to the lower end of the first container device and rotatable within a lower end opening of the first container device for ejecting disk bodies from the first container device;

a second container device which stores disk bodies is positioned adjacent the upper end of the first container device and includes an annular groove adjacent the upper end opening of the first container device; and conveying means for conveying the disk bodies from the second container device to the first container device including a flat ring member, the flat ring member is rotatably mounted adjacent the upper end opening to transport disk bodies from the second container device to the first container device by picking up disk bodies and dropping them into the first container device through the opening at the upper end.

* * * * *